United States Patent [19]

Mullen

[11] Patent Number: 4,641,320

[45] Date of Patent: Feb. 3, 1987

[54] SHROUD FOR FURNACE ELECTRODE

[75] Inventor: Michael J. Mullen, Sterling, Ill.

[73] Assignee: Northwestern Steel and Wire Company, Sterling, Ill.

[21] Appl. No.: 682,937

[22] Filed: Dec. 18, 1984

Related U.S. Application Data

[63] Continuation-in-part of Ser. No. 450,242, Dec. 16, 1982.

[51] Int. Cl.[4] ..... H05B 7/102

[52] U.S. Cl. ..... 373/96; 373/101

[58] Field of Search ..... 373/94, 96, 101, 55, 373/95, 98, 99, 100

[56] References Cited

U.S. PATENT DOCUMENTS 1,363,815 12/1920 Saklatwalla et al. ..... 373/101
3,717,445 2/1973 Yoshimura et al. ..... 373/94
4,490,825 12/1984 Persson ..... 373/96

FOREIGN PATENT DOCUMENTS 44401 9/1956 Fed. Rep. of Germany ..... 373/96

*Primary Examiner*—Roy N. Envall, Jr.
*Attorney, Agent, or Firm*—Hill, Van Santen, Steadman & Simpson

[57] ABSTRACT

A shroud assembly for an electric arc furnace in which a plurality of electrodes extend through the roof of the furnace and are adjustably positonable in a clamping type holder. The shroud is secured to each of the electrode holders and extends through the roof into the furnace, the shroud having a conductive ring disposed in the lower end of the shroud with the radial spacing between the lower end of the ring and the electrode being sufficiently small to provide substantial flow resistance to corrosive furnace gases tending to pass between the electrode and the ring, and the shroud having sufficient axial length to provide an abutment surface for the electrode, and lateral support, when the electrode is displaced from its normally vertical position thereby reducing the bending moment tending to break the electrode upon such displacement.

4 Claims, 3 Drawing Figures

SHROUD FOR FURNACE ELECTRODE

REFERENCE TO RELATED APPLICATION

This application is a continuation-in-part of my copending application Ser. No. 450,242, filed Dec. 16, 1982.

BACKGROUND OF THE INVENTION

1. Field of the Invention

This invention is in the field of electric arc furnace assemblies particularly of the type used for making steel and concerns itself with an improved shroud which fits around a portion of the electrode and protects the surface of the electrode from extensive exposure to corrosive gases and provides some lateral support when the electrode is displaced from its normally vertical position.

2. Description of the Prior Art

Electrodes for electric arc furnaces can be depleted by normal wear, by breakage, or by erosion caused by hot gases from the furnace being drawn along the tip of the electrode.

One of the major problems involving electrodes is that of breakage when the electrode comes into contact with the scrap steel in the furnace and is bent away from its normal vertical axis. Electric arc furnace electrodes are normally put together in sections. With a 28-inch diameter electrode, the full electrode may consist of three sections each about 110 inches long. The sections are joined together at their abutting surfaces typically by means of threaded nipples. When the electrode impacts against scrap steel in the bottom of the furnace, there is a substantial bending moment which frequently results in breakage of the electrode at the joint nearest the holder. The breakage of an electrode not only results in lost production time, but adds considerable expense to the steel making process.

There have been some disclosures in the prior art concerning devices for reducing the contact of the electrode surface with the corrosive gases of the furnace and in some cases providing a clamping pressure on the electrode under the roof of the furnace. For example, U.S. Pat. No. 1,363,815 to Saklatwalla et al. describes an electrode holder consisting of an outer metal casing which has a tapered opening or bore which seats a tapered metal ring or inner casing surrounding the electrode. A plurality of tapered metal wedges are arranged to be driven between the tapered interior of the ring and the cylindrical outer surface to secure the electrode and the ring together.

Sherman U.S. Pat. No. 2,979,550 describes an electrode seal having a stationary horizontal rim and a plurality of elongated cylindrical segments. The segments are pivotally supported from the rim on the inside so as to define a generally vertical aperture through which the electrode is received. The segments have internal passages for the circulation of water to serve as a coolant. Arrester blocks are provided between adjacent segments so as to form a gas-tight seal between the segments.

U.S. Pat. No. 2,982,804 to Reschke describes an electric arc furnace provided with a protective cylinder through which a gas is directed to protect the furnace against loss of heat, flame, and the presence of dirt around the cylinder.

U.S. Pat. No. 2,997,511 to Turner describes a water-cooled electrode head through which cooling water circulates, the cooling water directly engaging the copper body of the electrode head without an intervening cooling coil so that heat will be transferred effectively between the copper and the cooling water.

Krogsrud U.S. Pat. No. 4,434,496 provides a holder assembly for an electrode comprising a plurality of contact clamps which are pressed together toward the electrode by means of pressure-applying means and an external thrust member. The holder assembly is arranged to conduct current, coolant, and pressure agent to the contact clamps.

A shroud type cover is disclosed in U.S. Pat. No. 4,189,617 which deals with a liquid cooled electrode for electric arc furnaces. This patent suggests a cover which is electrically insulated from the electrode core, and in addition provides a device for producing a magnetic field in the lower portion of the cover. By means of the magnetic field, the electric arc is moved over the tip of the core so that an optimum position of the electrode tip can be defined by adjusting the axial displacement of the core.

European Pat. application No. 12573 of Montgomery describes an electrode including a water-cooled tubular column containing a number of interconnected graphite or carbon sections. The column surrounds one or more centrally extending bus bars and is insulated from them.

Mathgen et al. U.S. Pat. No. 4,457,002 is directed to a seal for an electrode passing through a furnace wall. The seal assembly is part of a closed chamber which is pressurized with an inert gas. A packing assembly compresses the seal ring radially against the electrode and includes split compression rings bearing axially on the seal ring.

Japanese Pat. No. 58-19892 provides an electrically conductive cylinder at least partially surrounding the part of the electrode extending into the furnace. The cylinder is water-cooled and delivers arc current to the tip of the electrode.

German Pat. No. 44401 to Wotschke employs a conductive shroud and ring in conjunction with a rotatable electrode for an arc furnace.

SUMMARY OF THE INVENTION

The present invention provides an improved shroud for electrodes in an electric arc furnace, the shroud being secured to one of the electrode holders and extending through the furnace roof into the furnace. The electrode extends through the shroud and is loosely received within a conductive ring disposed in the lower end of the shroud. The radial spacing between the lower end of the ring and the electrode is sufficiently small to provide substantial flow resistance to corrosive furnace gases tending to pass between the electrode and the ring. The shroud has sufficient axial length to provide an abutment surface for the electrode when it is displaced from its vertical position as by contact with the scrap in the furnace. This reduces the bending moment tending to break the electrode upon displacement of the electrode.

The ring preferably consists of ring segments which have a tapered configuration, matching an internally tapered wall of the shroud. The electrode is free to slide within the ring so that the ring does not provide clamping pressure against the electrode but provides some lateral support through engagement with the electrode upon bending, thereby reducing the lever arm acting on the vulnerable portions of the electrode assembly, particularly the upper joints. In the preferred form of the invention, the shroud is provided with means for circulating a coolant such as water through the shroud.

BRIEF DESCRIPTION OF THE DRAWINGS

The preferred embodiment of the present invention is illustrated in the attached sheet of drawings in which.

DESCRIPTION OF THE PREFERRED EMBODIMENTS

Figure 1:
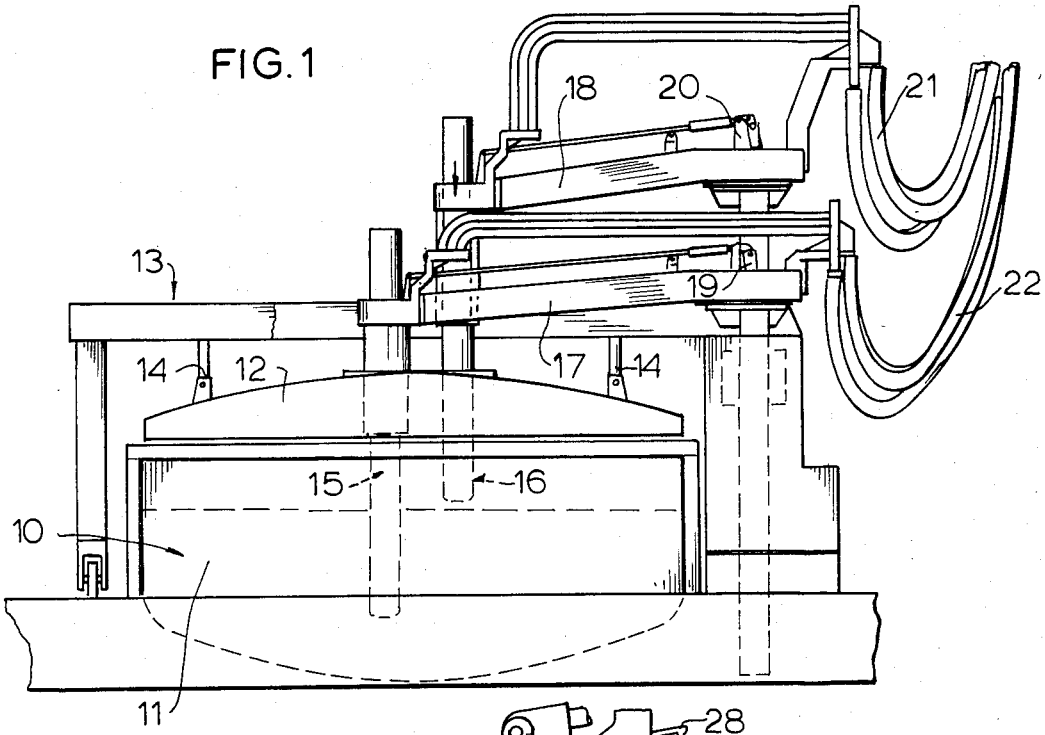
FIG. 1 is a view in elevation of an electric arc furnace assembly of the type to which the present invention is applicable.

In FIG. 1, reference numeral 10 indicates generally an electric furnace assembly including a furnace body 11 and a removable roof 12. The roof 12 is supported from a support structure generally indicated at reference numeral 13 by means of pivoted arms 14. In this type of furnace, the roof structure is capable of being raised and lowered relative to the furnace body and then swung into an out-of-the-way position for the purposes of charging the furnace with steel scrap and discharging molten material. Since the mechanical structure for accomplishing these purposes is well known and forms no part of the present invention, such structures are not shown in detail.

The furnace assembly is equipped with a conventional three-electrode configuration for energization by three-phase alternating current, as is conventional in the art. For purposes of illustration, an electrode 15 is shown substantially immersed within the contents of the furnace, while a second electrode 16 is shown in an intermediate position as it might be during raising or lowering. Each of the electrodes 15 and 16 is normally composed of graphite. Electrodes receive all of their vertical support from electrode support arms 17 and 18, respectively. Clamping engagement between the electrode and its associated support arm is provided by a plurality of water-cooled air operated cylinders 19 and 20. The details for the mechanical clamping of the electrode within its holder are also well known and do not form any part of the present invention. Finally, electrical cables 21 and 22 are provided to energize each of the electrodes with an appropriate source of potential.

Figure 2:
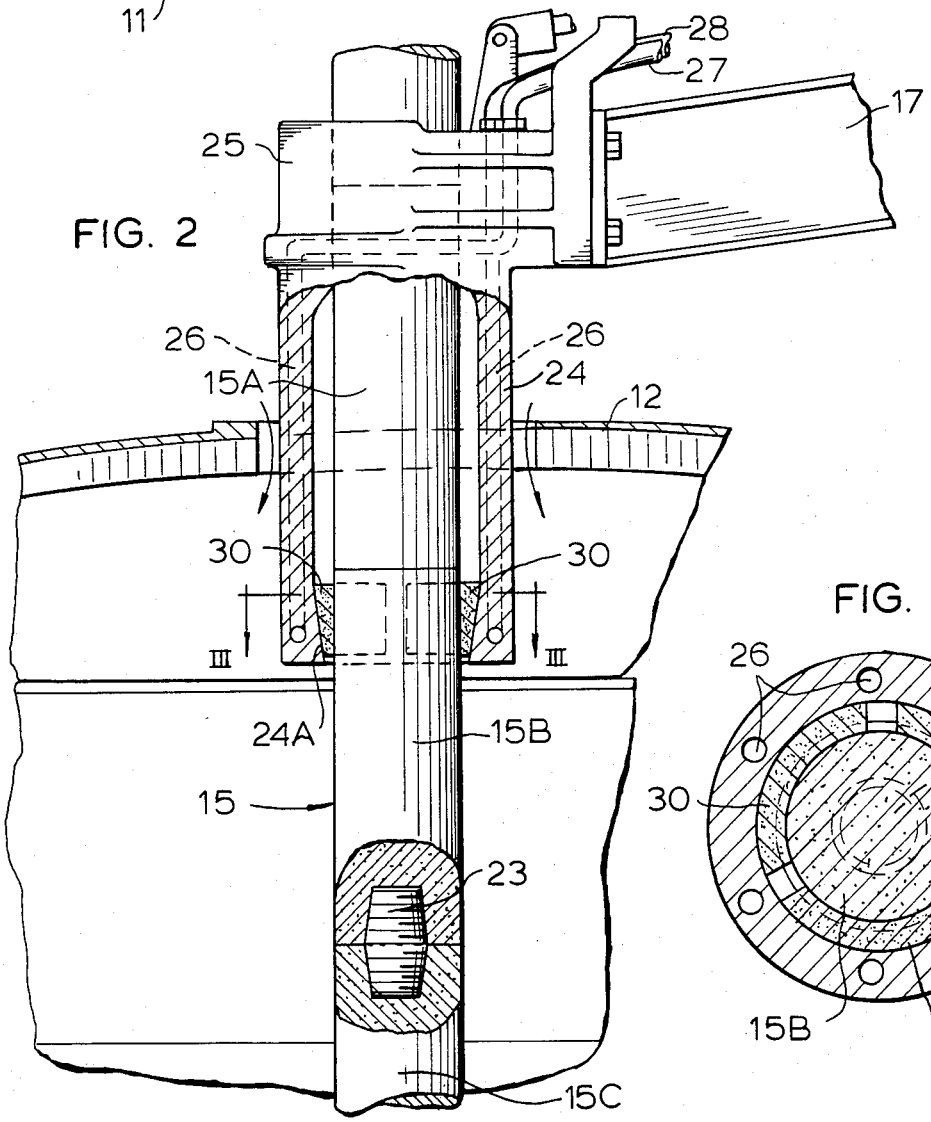
FIG. 2 is a fragmentary view partly in elevation and partly in cross section of one of the improved shrouds of the present invention shown in combination with an electrode.
Figure 3:
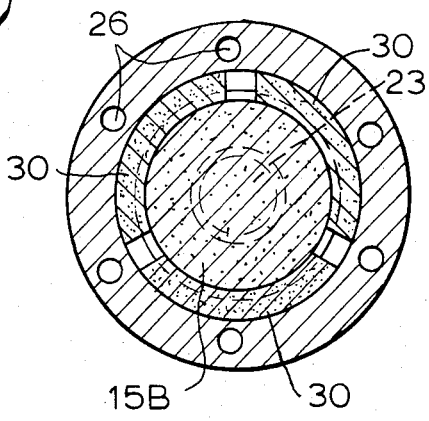
FIG. 3 is a cross-sectional view taken substantially along the line III—III of FIG. 2.

One form of the improved shroud of the present invention is illustrated in the enlarged views of FIGS. 2 and 3. As seen in those Figures, the electrode 15 is composed of a number of sections 15A, 15B, 15C, and so on. The sections are joined together at their extremities by securing means such as threaded nipples 23, one of which is illustrated in FIG. 2. Thus, as the individual sections are broken or eroded, additional sections of the electrode can be added from the top and fed as required.

As illustrated in FIG. 2, the electrode is received through a coaxial shroud assembly composed of a hollow cylindrical body 24 which is composed of an electrically conductive material such as copper or stainless steel. The upper end of the shroud assembly is secured to a collar 25 which is connected to the electrode support arm 17 and provides the sole vertical support for the weight of the electrode.

The shroud body 24 is cooled during operation by the provision of coolant passages 26 which are connected to a fluid intake line 27 and have a discharge line 28 for recirculating the coolant such as water back to the source (not shown). The coolant passages form a continuous serpentine arrangement within the middle of the cylindrical body portion 24.

The lower end of the cylindrical body portion 24 has a tapered surfaces 24A. Mating with this surface 24A are a plurality of electrically conductive segments 30 composed of graphite or other electrically conductive material. The engagement between the segments 30 and the electrode 15 is only tight enough to permit conduction of electrical current, but not strong enough to hold the electrode in a clamping angagement. The segments have a vertical taper so that the thickness of the segment increases from the bottom to the top, the taper matching the taper of the annular surface 24.

As illustrated in FIG. 2, the shroud does not extend to a substantial depth within the furnace. In the prior art, such shroud assemblies were made considerably longer so that they had to be insulated because they could be lowered into the furnace to a point where they could contact scrap metal. In the form of the invention shown in FIGS. 1 to 3, the shroud has been shortened considerably so that it only extends past the first joint or so in the electrode. Since it is much shorter and can be made much lighter in weight, it can be attached directly to the electrode holder instead of being supported from the roof.

In addition, any bending moment provided by flexing or displacement of the electrode tending to bend the electrode within the furnace is absorbed by the segments 30 which are free to ride up the inner wall of the cylindrical body portion 24 when such displacement occurs. Consequently, the effective bending arm is decreased in length and the possibility of catastrophic failure is reduced. Since there is only a slight clearance between the segments 30 and the surface of the electrode, the tendency for the electrode to be affected by corrosive gases is reduced since the upper end of the electrode is effectively sealed from the corrosive environment. In addition, the upper end of the electrode is effectively shielded from the radiation of heat in the upper part of the furnace.

The improved shrouds of the present invention thus reduce the tendency of oxidation to occur due to gases coming up the electrode surface. They also shield the upper portion of the electrode from radiated heat in the furnace. By providing a twopoint support, the electrode is no longer subjected to bending in a cantilever fashion which reduces the tendency of the electrode to break under stress.

It should be evident that various modifications can be made to the described embodiments without departing from the scope of the present invention.

I claim as my invention:

1. An electric arc furnace assembly comprising:

a furnace body, a roof removably secured to said furnace body, a plurality of electrode holders positioned above said roof, an electrode adjustably positionable in each holder for controlled insertion into said furnace, each electrode being supported in depending relation with said furnace body solely by the support from its associated holder, a shroud secured to each of said electrode holders and having a lower end extending through said roof into said furnace, each electrode extending through one of said shrouds, each shroud having an internally tapered wall therein, a conductive split ring disposed in the lower end of said shroud, said ring consisting of ring segments having a taper corresponding to the taper of said tapered wall and being free to ride up the inner wall of said shroud when lateral displacement of the electrode extending therethrough occurs, the radial spacing between the lower end of said ring and said electrode being sufficiently small to provide substantial flow resistance to corrosive furnace gases tending to pass between said electrode and said ring, said shroud having sufficient axial length to provide a lateral abutment surface for said electrode when said electrode is displaced from its vertical position, thereby reducing the bending moment tending to break said electrode upon such displacement.

2. In an electric arc furnace assembly including a furnace body, a removable roof over said body, electrodes extending through said roof and electrode holders holding said electrodes with their lower ends in adjustable vertical positions within said furnace body, the improvement which comprises:

a hollow shroud coaxial with each electrode and spaced slightly therefrom, said shroud extending through said roof and into said furnace body, a collar connected to said shroud and providing the sole vertical support for said electrode in said furnace body, a split electrically conductive ring confined within the lower end of said shroud, said ring permitting sliding movement of said electrode therethrough, said ring being capable of shifting within said shroud to accommodate movement of said electrode thereagainst, said shroud and said ring providing lateral support for said electrode when said electrode orientation deviates from the vertical, thereby reducing the tendency of said electrode to break from bending stresses.

3. An electric arc furnace according to claim 2 wherein said ring is composed of tapered segments having a larger thickness at their tops than at their bottoms.

4. An electric arc furnace according to claim 3 which includes tapered wall means within said shroud having a taper corresponding to that of said segments.

* * * * *